United States Patent [19]

Hahndorff

[11] 4,360,757

[45] Nov. 23, 1982

[54] ELECTRODE ACTIVATING COMPOUND FOR GAS DISCHARGE TUBE

[75] Inventor: Axel Hahndorff, Berlin, Fed. Rep. of Germany

[73] Assignee: Siemens Aktiengesellschaft, Berlin & Munich, Fed. Rep. of Germany

[21] Appl. No.: 129,244

[22] Filed: Mar. 11, 1980

[30] Foreign Application Priority Data

Apr. 11, 1979 [DE] Fed. Rep. of Germany ..... 2914836

[51] Int. Cl.[3] ..... H01J 61/06; H01J 17/04

[52] U.S. Cl. ..... 313/218; 313/346 R

[58] Field of Search ..... 313/218, 213, 346 R, 313/217, 325; 423/608; 252/507, 520

[56] References Cited

U.S. PATENT DOCUMENTS

| | | | |
|---|---|---|---|
| 867,456 | 10/1907 | Weedon | 252/507 |
| 3,439,261 | 4/1969 | Loh et al. | 313/218 X |
| 3,676,743 | 7/1972 | Bahr et al. | 313/218 X |
| 3,691,428 | 9/1972 | Bahr et al. | 313/218 X |

FOREIGN PATENT DOCUMENTS

| | | | |
|---|---|---|---|
| 1935734 | 1/1971 | Fed. Rep. of Germany . | |
| 1950090 | 1/1973 | Fed. Rep. of Germany . | |
| 1951601 | 7/1975 | Fed. Rep. of Germany . | |
| 1280938 | 7/1972 | United Kingdom . | |
| 1322837 | 7/1973 | United Kingdom | 423/608 |

*Primary Examiner*—Marvin L. Nussbaum

*Attorney, Agent, or Firm*—Hill, Van Santen, Steadman, Chiara & Simpson

[57] ABSTRACT

An electrode activating compound for a gas discharge tube such as a surge voltage arrester, triggerable gas discharge tubes and flash tubes in which a titanium oxide is used in place of the radioactive thorium oxide. Preferably, the titanium oxide is provided by a reduction of a titanium dioxide with a reducing agent such as $BaAl_4$ or metallic titanium or by oxidation of a titanium hydride in either an oxidizing atmosphere or with an oxidizing compound.

15 Claims, 1 Drawing Figure

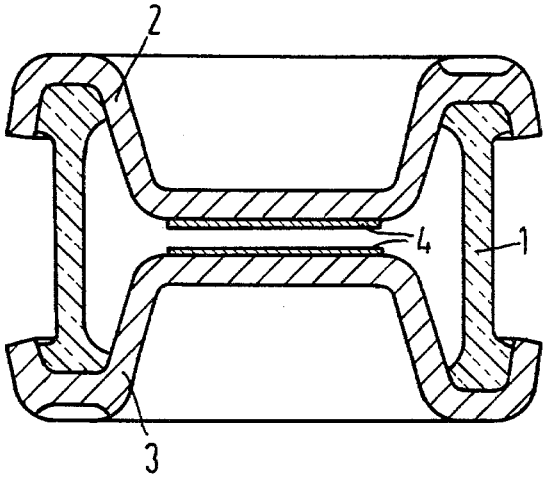
2
4
1
3

ELECTRODE ACTIVATING COMPOUND FOR GAS DISCHARGE TUBE

BACKGROUND OF THE INVENTION

The present invention is concerned with an electrode activating compound for a gas discharge tube containing a metal oxide selected from a metal of the fourth subgroup of the periodic system.

An electrode activating compound, which utilizes a metal oxide from the fourth subgroup of the periodic table, for the electrodes of a voltage overload arrester or a surge voltage arrester is disclosed in U.S. Pat. No. 3,691,428 which was based on German O.S. No. 19 35 734. In this U.S. patent, an electrode activating compound included thorium oxide.

Electrode activating compounds are generally used in the case of gas discharge tubes and according to the purpose of the application are composed to significantly influence the important electric characteristic quantities in each case. Where the gas discharge tube is utilized as a surge voltage arrester or is used as a controllable switching tube, which is known as a cold cathode thyratron, or is used as a flash tube, an important requirement is directed towards a low glow-arc transition. This is defined as a momentary current value in the case of which the fired gas discharge crosses over from a glow discharge into an arc discharge. Low values produce a good firing behavior, above all, in the case of firing via a third electrode with low firing currents, and by means of good current carrying capacity, they produce a long service life. Beyond this, the minimum operating voltage is advantageously of a small value.

A low glow-arc transition can be attained with an electrode activating compound which, among other things, contains a radioactive thorium oxide as an effective constituent. The security measures, which are necessary because of the radioactivity and therefore the danger to the environment, as well as the considerable waste disposal costs, provide a serious disadvantage to the use of thorium oxide as an electrode activating compound.

SUMMARY OF THE INVENTION

The present invention is based upon the problem of replacing the radioactive thorium oxide by means of a material, which is not radioactive. In addition, the material of the invention is not expensive and in particular it does not combine a low glow-arc transition with other disadvantages such as it could be too easily atomized, vaporized so that conducting deposits would occur upon the interior wall of the gas discharge container and therefore create short circuits.

For the solution of this problem, the invention is directed in providing an electrode activating compound containing a metal oxide of a metal selected from the fourth subgroup of the periodic table, said metal oxide being titanium oxide.

With a "titanium oxide", it is to be expressed that depending upon the purpose of the application and depending upon the desired electrical characteristic qualities in connection with other factors such as electrode surface, electrode spacing, gas pressure, internal firing and self firing, the titanium in the oxide is either quadrivalent or has a lower valence and it can also be composed non-stoichiometrically in its valence. It is essential that titanium oxide is a non-toxic and is an inexpensive substance. It is also essential that the titanium oxide in the electrode activating compound, even in the case of extremely small currents and low voltages, enables an unwavering arc discharge to be maintained. Titanium oxide combines a good electron emission ability with a relatively poor thermal conductivity.

In order to obtain the desired titanium oxide in the electrode activating compound, one has essentially two possibilities. The compound is generally applied as a mixture in the form of a paste upon the electrode or upon the electrodes and is formed in a forming process with the compound which is active in the operation. One possibility consists in beginning with quadrivalent titanium dioxide and during the forming process producing a lower valent titanium oxide. The other possibility consists in beginning from either a group consisting of titanium or titanium hydrides in the forming process and producing a higher valent titanium oxide.

In accordance with this, and according to one design of the invention, it is proposed that the electrode activating compound be formed from a material, which has a constituent selected from a group consisting of titanium and titanium hydride, includes an oxidation agent and is applied to the electrode. During a forming process of the electrodes, titanium oxide is formed at least partially due to oxidation. In another proposed method, a material mixture containing a constituent selected from a group consisting of titanium and titanium hydride is applied on the electrode and during the forming process is partially oxidized in an oxygen containing gas atmosphere.

According to the other proposed process, an electrode activating compound is produced by applying on the electrodes a material which contains a titanium dioxide and a reducing agent. In the presence of the reducing agent or means during the forming process of the electrodes, the titanium dioxide is reduced at least partially into a lower valent titanium oxide.

The reducing agent or means which is included in the material for one thing can be metallic titanium, a barium-aluminum alloy, or an alkali compound which is selected from a group consisting of potassium azide and potassium boranate. The use of titanium, as a reducing compound is disclosed in German Pat. No. 1,951,601. It is also noted that U.S. Pat. No. 3,676,743, which is based on German Pat. No. 1,950,090, disclosed utilizing a barium-aluminum alloy as a coating on electrodes in a voltage overload arrester to produce an essentially lower electron work function and a stabilizing effect.

With the help of the electrode activating compound in accordance with the present invention, both a high response direct voltage and a high maximum operating voltage of the gas discharge tube are obtained. In addition, a low minimum operating voltage and low arc drop voltage will be obtained. By means of a low energy conversion, the service life is very high because the glow range can be kept low with voltage and current.

The large ratio which is attained with the "maximum operating voltage without spontaneous firing" to the "minimum operating voltage with 50% probability of firing in the case of admission with a specific triggering pulse" in the case of a triggerable gas discharge tubes can be utilized technically in an advantageous manner. The maximum operating voltage may be very high, or the minimum response direct voltage, which is still triggerable, can be very low. However, also the demand can be raised for example to this extent that data sheet specifications are fulfilled not only in one polarity, but rather in both polarities.

Further, low firing currents are advantageous especially in the case of triggerable gas discharge tubes. Discharge currents under 10 mA can be generated simply without glass-to-metal sealed lead-through for firing the main discharge. A conducting cover which is applied on the exterior of the container, will suffice with an alternating voltage of at least 2 kV at 0.1 MHz to overcome the capacity resistance of the container wall. Prerequisite for the firing of the arc is then only a significant high gas pressure of approximately 400 m bar to 500 m bar in the discharge container. The firing begins at the cathode upon a very small spot with a glow discharge of a high power density for example, several kW per $cm^2$, and after approximately $10^{-5}$ seconds, an arc low end, which glows white and emits electrons, occurs. As soon as this subdischarge path has fired to the container wall, the gas discharge tube can transfer into a main discharge path or respectively in the case of a flash tube can short circuit a flash capacitor if its charging voltage lies noticeably over the arc drop voltage of the subdischarge path. A filling gas, an inert gas like argon, can be utilized, or xenon can be used if light efficiency or color plays a role.

If the electron activating compound contains in addition to the titanium oxide, an alkali halide in particular potassium iodide, potassium bromide or potassium chloride, additional advantages will occur. The use of alkali halide in over voltage arresters is disclosed in the above mentioned German Pat. No. 1,951,061.

In practice, a mixture of titanium dioxide, barium-aluminum alloy and potassium halide are to be recommended. The composition of this mixture is to be accomodated to the pressure of the gas atmosphere. The potassium halide is a compound selected from a group consisting of potassium iodide, potassium bromide and potassium chloride.

Various ranges are possible for example, $TiO_2$ from 2% to 60%, $BaAl_4$ from 5% to 50% and in the case of KX from 0% to 80% where X=Cl, Br, or I. The firing voltage is determined by the ratio of $TiO_2$ and the reducing agent. In the case of ratio of the $TiO_2$:$BaAl_4$<1, the firing voltage drops and a brownish or violet wall deposit will occur.

As optimum examples, with a gas pressure of 450 m bar of argon, a composition of 40% $TiO_2$, 40% $BaAl_4$ and 20% KX can be used. When the gas pressure is 90 m bar then a mixture of 10% $TiO_2$, 20% $BaAl_4$ and 70% KX is utilized.

BRIEF DESCRIPTION OF THE DRAWING

The FIGURE is a cross section of a surge voltage arrester in accordance with the present invention.

DESCRIPTION OF THE PREFERRED EMBODIMENTS

The principles of the present invention can be utilized in a gas discharge tube such as a surge voltage arrester having a so called button arrester shape which has truncated cone-shaped electrodes 2 and 3 which are facing towards each other and spaced apart by a tubular shape insulating body 1 which are secured together in a gas tight arrangement. The material for the insulating body preferably is glass or ceramic. The material for the electrodes 2 and 3 consists of a Ni-Fe alloy, or Ni-Fe-Co alloy. As illustrated each of the electrodes 2 and 3 on a surface which lies opposite one another, has a layer 4 applied. This layer 4 contains an electrode activating compound according to the present invention which contains a titanium oxide.

Although various minor modifications may be suggested by those versed in the art, it should be understood that I wish to embody within the scope of the patent granted hereon, all such modifications as reasonably and properly come within the scope of my contribution to the art.

I claim:

1. A material for use in forming an electrode activating compound for a gas discharge tube, said compound consisting of a metal oxide of a metal from the fourth subgroup of the periodic table, said metal oxide being a titanium oxide having a valence lower than quadrivalent titanium oxide, said material being applied on an electrode before processing of the electrode and including a constituent selected from a group consisting of titanium and titanium hydride, said constituent during processing of the electrode being partially oxidized by an oxygen-containing atmosphere to produce the titanium oxide with a valence lower than quadrivalent titanium oxide.

2. A material for use in forming an electrode activating compound for a gas discharge tube, said compound consisting of a metal oxide of a metal from the fourth subgroup of the periodic table, said metal oxide being a titanium oxide having a valence lower than quadrivalent titanium oxide, said material being applied on an electrode before processing of the electrode and including an oxidization compound and a constituent selected from a group consisting of titanium and titanium hydride, said constituent during processing of the electrode being partially oxidized to produce the titanium oxide with a valence lower than quadrivalent titanium oxide.

3. A material for use in forming an electrode activating compound for a gas discharge tube, said compound consisting of a metal oxide of a metal from the fourth subgroup of the periodic table, said metal oxide being a titanium oxide having a valence lower than quadrivalent titanium oxide, said material including a reducing agent and titanium dioxide and being applied on the electrode before processing of the electrode, said titanium dioxide during processing of the electrode being partially reduced to produce the titanium oxide with a valence lower than quadrivalent titanium oxide.

4. A material according to claim 3, wherein the reducing agent includes a metallic titanium.

5. A material according to claim 3, wherein the reducing agent is a barium-aluminum alloy.

6. A material according to claim 3, wherein the reducing agent comprises an alkali compound.

7. A material according to claim 6, wherein the alkali compound is selected from a group consisting of potassium azide and potassium boranate.

8. A material according to claim 3, wherein the titanium dioxide is between 2% to 60% of the material, said reducing agent is $BaAl_4$ in a range of 5% to 50%, and the material includes a potassium halide selected from a group consisting of potassium chloride, potassium iodide, and potassium bromide, said potassium halide being in a range of 0% to 80%.

9. A material according to claim 8, wherein the material is composed of 40% $TiO_2$, 40% $BaAl_4$ and 20% of the potassium halide and the discharge tube has an atmosphere of argon at a pressure of 450 m bar.

10. A material according to claim 8, wherein the material comprises 10% $TiO_2$, 20% $BaAl_4$ and 70% of the potassium halide and the atmosphere of the discharge tube is argon at a pressure of 90 m bar.

11. A material according to claim 3, which includes an alkali halide selected from a group consisting of potassium iodide, potassium bromide and potassium chloride.

12. A method of providing an electrode activating compound on an electrode for a discharge tube, said method comprising providing a material including a constituent selected from a group consisting of titanium and titanium compounds, applying said material on at least one electrode of the gas discharge tube, processing the electrode to cause the material to react with other materials to produce a titanium oxide having a lower valence than the quadrivalent titanium oxide.

13. A method according to claim 12, wherein the titanium compound is titanium hydride and said material includes an oxidation compound so that during the step of processing, a partial oxidation of the titanium produces a titanium oxide.

14. A method according to claim 12, wherein the titanium compound is titanium hydride and wherein the processing of the electrode is conducted in an oxygen containing gas atmosphere so that at least a partial oxidation of the titanium occurs.

15. A process according to claim 12, wherein the constituent is titanium dioxide and the material includes a reducing agent selected from a group consisting of metallic titanium, a barium-aluminum alloy and alkali compounds, said reducing agent partially reducing the titanium dioxide to the lower valent titanium oxide during the forming step.

* * * * *